US007725046B2

(12) United States Patent
Masuda

(10) Patent No.: US 7,725,046 B2
(45) Date of Patent: May 25, 2010

(54) IMAGE FORMING APPARATUS WITH ION GENERATOR

(75) Inventor: Yoshiaki Masuda, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 286 days.

(21) Appl. No.: 11/934,281

(22) Filed: Nov. 2, 2007

(65) Prior Publication Data

US 2008/0124123 A1 May 29, 2008

(30) Foreign Application Priority Data

Nov. 29, 2006 (JP) ..... 2006-322633

(51) Int. Cl.
*G03G 15/00* (2006.01)
*G03G 15/22* (2006.01)
*G03G 15/16* (2006.01)

(52) U.S. Cl. ..... 399/46; 399/148; 399/296

(58) Field of Classification Search ..... 399/46, 399/115, 148, 296, 302, 312
See application file for complete search history.

(56) References Cited

U.S. PATENT DOCUMENTS 5,983,060 A 11/1999 Namekata

FOREIGN PATENT DOCUMENTS

| | | |
|---|---|---|
| JP | 08-015947 | 1/1996 |
| JP | 10-274892 | 10/1998 |
| JP | 2000-221798 | 8/2000 |
| JP | 2001-92275 | 4/2001 |
| JP | 2005-055695 | 3/2005 |
| JP | 2005-274588 A | 10/2005 |

*Primary Examiner*—David M Gray
*Assistant Examiner*—Gregory H Curran
(74) *Attorney, Agent, or Firm*—Nixon & Vanderhye PC

(57) ABSTRACT

Ions generated by the ion generating section are discharged from a paper sheet conveyer belt nozzle and an intermediate transfer belt nozzle, so that (i) a toner image transferred from a photosensitive drum onto an intermediate transfer belt and having yet to be transferred from the intermediate transfer belt onto a recording paper sheet and (ii) a paper sheet conveyer belt are charged. This makes it possible to more appropriately transfer a toner image onto a recording paper sheet from a photosensitive drum in an image forming apparatus, including a conveyer belt for conveying a recording paper sheet, in which a toner image formed on an image carrier is transferred onto an intermediate transfer body and the toner image is transferred from the intermediate transfer body onto a recording material; and to simultaneously prevent an increase in size of the image forming apparatus.

16 Claims, 4 Drawing Sheets

IMAGE FORMING APPARATUS WITH ION GENERATOR

This Nonprovisional application claims priority under 35 U.S.C. §119(a) on Patent Application No. 322633/2006 filed in Japan on Nov. 29, 2006, the entire contents of which are hereby incorporated by reference.

FIELD OF THE TECHNOLOGY

The present technology relates to electrophotographic image forming apparatuses. More specifically, the present technology relates to an image forming apparatus including (i) an intermediate transfer body for conveying a toner image transferred from an image carrier onto the intermediate transfer body and transferring the toner image onto a recording material and (ii) conveying means for supporting and conveying the recording material.

BACKGROUND OF THE TECHNOLOGY

Conventionally, there has been known an image forming apparatus in which a toner image formed on an image carrier is transferred onto an intermediate transfer body and the toner image thus transferred onto the intermediate transfer body is transferred onto a recording material (e.g., see Patent Documents 1 and 2 listed below).

When the image forming apparatus thus arranged shows variations in charging amount of the toner image transferred onto the intermediate transfer body, the toner image may not be appropriately transferred from the intermediate transfer body onto the recording material.

In order to reduce variations in charging amount of a toner image transferred onto an intermediate transfer body, Patent Document 3 listed below discloses an image forming apparatus including pre-transfer charging means for charging a toner image having yet to be transferred from an intermediate transfer body onto a recording material.

Further, according to Patent Document 3, a second transfer belt for conveying a recording material and an electricity-removing charger for ridding the second transfer belt of residual charge are provided at a point of contact between the intermediate transfer body and a recording material. Further, in order to prevent printing misalignment from being caused by a recording material floating when a toner image is transferred from an intermediate transfer body onto the recording material, Patent Document 4 discloses an image forming apparatus including (i) a conveyer belt for conveying a recording material and (ii) a charging roller for charging the recording material and the conveyer belt so that the recording material and the conveyer belt electrostatically cling to each other.

However, the technique of Patent Document 3 requires a pre-transfer charging means for charging a toner image transferred onto an intermediate belt and an electricity-removing charger for ridding a second transfer belt of residual charge, and therefore undesirably causes an increase in size of the image forming apparatus.

Further, in order to more appropriately transfer a toner image onto a recording material in an image forming apparatus in which a toner image formed on an image carrier is transferred onto an intermediate transfer body and the toner image thus transferred onto the intermediate transfer body is transferred onto a recording material, the technique of Patent Document 3 and the technique of Patent Document 4 may be combined. However, such a combination also makes it necessary to provide two charging devices, and therefore undesirably causes an increase in size of the image forming apparatus. Note that the arrangement obtained by combining the technique of Patent Document 3 and the technique of Patent Document 4 is an arrangement devised by the inventor of the subject application, and is not a publicly known arrangement.

(Patent Document 1)
Japanese Unexamined Patent Application
Publication No. 92275/2001 (Tokukai 2001-92275; published on Apr. 6, 2001)

(Patent Document 2)
Japanese Unexamined Patent Application Publication No. 15947/1996 (Tokukaihei 8-15947; published on Jan. 19, 1996)

(Patent Document 3)
Japanese Unexamined Patent Application Publication No. 274892/1998 (Tokukaihei 10-274892; published on Oct. 13, 1998)

(Patent Document 4)
Japanese Unexamined Patent Application Publication No. 221798/2000 (Tokukai 2000-221798; published on Aug. 11, 2000)

SUMMARY OF THE TECHNOLOGY

The present technology has been made in view of the foregoing problems, and it is an object to more appropriately transfer a toner image onto a recording material from an image carrier in an image forming apparatus, including a conveyer belt for conveying a recording material, in which a toner image formed on an image carrier is transferred onto an intermediate transfer body and the toner image thus transferred onto the intermediate transfer body is transferred onto a recording material; and to simultaneously prevent an increase in size of the image forming apparatus.

In order to solve the foregoing problems, an image forming apparatus includes (i) a photoreceptor for carrying a toner image, (ii) an intermediate transfer body onto which the toner image is transferred from the photoreceptor, and (iii) recording material conveying means for supporting a recording material and conveying the recording material to a point where the recording material conveying means faces the intermediate transfer body, and transfers the toner image from the intermediate transfer body onto the recording material at the point, the image forming apparatus comprising a charge imparting device which includes (a) an ion generating section for generating ions, (b) a first imparting section for imparting charge, with use of the ions generated by the ion generating section, to the toner image transferred onto the intermediate transfer body and having yet to be transferred from the intermediate transfer body onto the recording material, and (c) a second the recording material conveying means with use of the ions generated by the ion generating section.

According to the foregoing arrangement, the image forming apparatus has a charge imparting device which includes (a) an ion generating section for generating ions, (b) a first imparting section for imparting charge, with use of the ions generated by the ion generating section, to the toner image having yet to be transferred from the intermediate transfer body onto the recording material, and (c) a second imparting section for imparting charge to the recording material conveying means with use of the ions generated by the ion generating section. That is, both the toner image transferred onto the intermediate transfer body and the recording material conveying means are charged with use of the ions generated by the common ion generating section. Therefore, as compared with an arrangement in which a charge generating device for charging the toner image transferred onto an intermediate transfer body and a charge generating device for the charging recording material conveying means are separately provided, it is possible to reduce the size of the image forming apparatus and the amount of power to be consumed by the image forming apparatus. Further, the characteristics of the toner image being transferred from the intermediate transfer body onto the recording material can be stabilized by uniformly charging the toner image transferred onto the intermediate transfer body. Further, when the toner image transferred onto the intermediate transfer body and having yet to be transferred from the intermediate transfer body onto the recording material is charged so as to better cling to the intermediate transfer body, the toner image transferred on the intermediate transfer body can be prevented from dropping or scattering from the intermediate transfer body. Further, the recording material can be stably conveyed by imparting, to the recording material conveying means, charge for ridding the recording material conveying means of residual charge or charge for causing the recording material to electrostatically cling to the recoding material conveying means.

Additional objects, features, and strengths of the present technology will be made clear by the description below. Further, the advantages will be evident from the following explanation in reference to the drawings.

BRIEF DESCRIPTION OF THE DRAWINGS

FIGS. 3(*b*) through 3(*e*) are plan views of modified examples of the paper sheet conveyer belt nozzle and the intermediate transfer belt nozzle.

DESCRIPTION OF THE EMBODIMENTS

An embodiment of the present technology will be described below.

Figure 1:
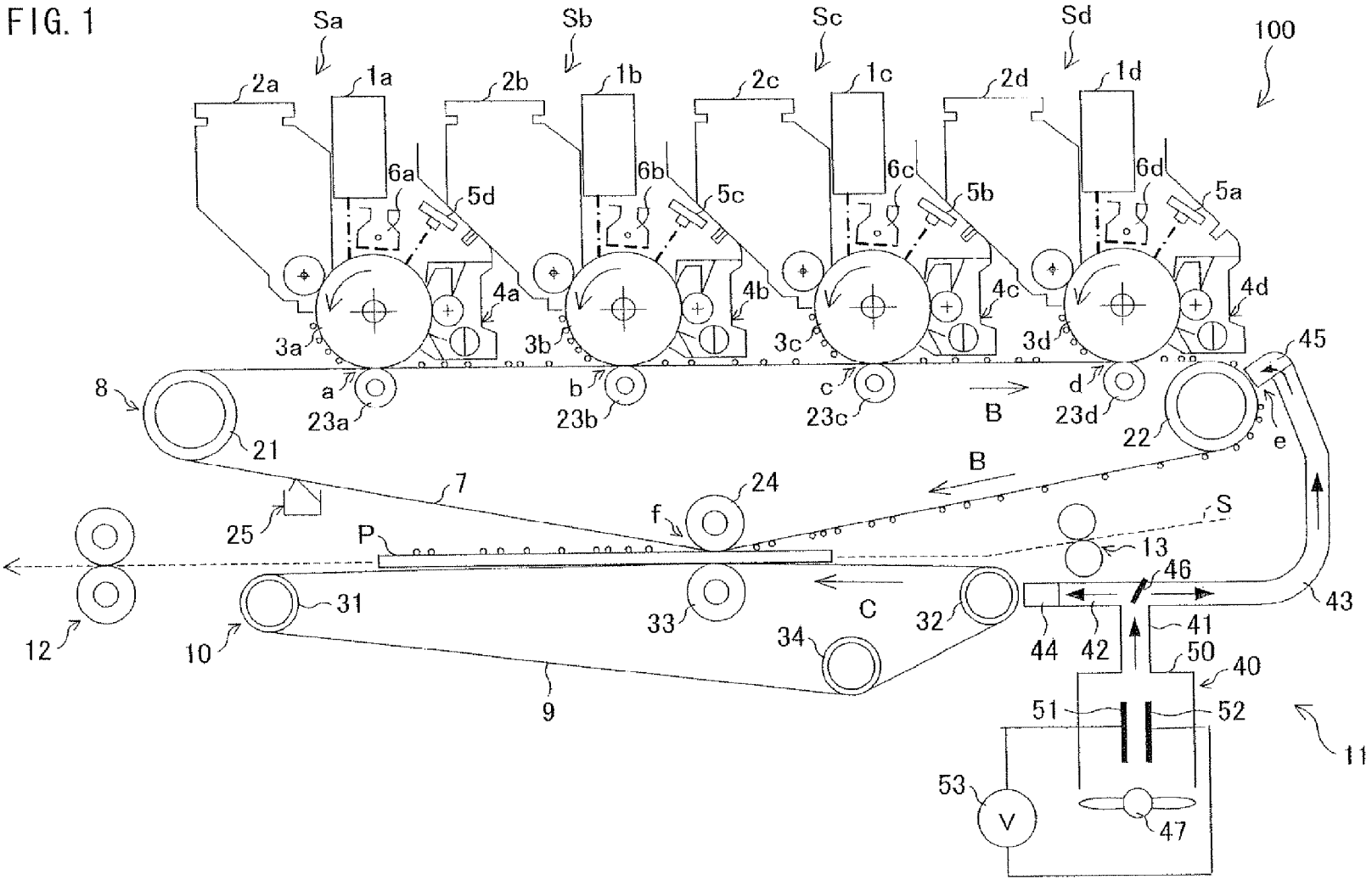
FIG. 1 is a cross-sectional view schematically showing a structure of an image forming apparatus.

FIG. 1 is a cross-sectional view schematically showing a structure of an image forming apparatus 100 according to the present embodiment. Note that the image forming apparatus 100 is a color tandem image forming apparatus that forms a multicolor or monochrome image on a recording paper sheet (recording material) in accordance with external image data or image data created by an image reading device (not shown).

As shown in FIG. 1, the image forming apparatus 100 includes exposure units 1*a* to 1*d*, developing devices 2*a* to 2*d*, photosensitive drums 3*a* to 3*d*, cleaner units 4*a* to 4*d*, electricity-removing devices 5*a* to 5*d*, charging devices 6*a* to 6*d*, an intermediate transfer belt 7, an intermediate transfer belt unit 8, a paper sheet conveyer belt 9, a paper sheet conveyer belt unit 10, a charge imparting device 11, a fixing unit 12, a paper sheet conveying path S, and the like. Note that the operation of each of the components of the image forming apparatus 100 is controlled by a CPU (control section; not shown).

The image forming apparatus 100 processes image data corresponding to a color image created with black (K), cyan (C), magenta (M), and yellow (Y). Therefore, as shown in FIG. 1, the developing devices 2*a* to 2*d*, the photosensitive drums 3*a* to 3*d*, the cleaner units 4*a* to 4*d*, the electricity-removing devices 5*a* to 5*d*, and the charging devices 6*a* to 6*d* are provided so as to form four types of latent image corresponding to the colors (K, C, M, and Y), respectively. Moreover, these components constitute four image stations Sa, Sb, Sc, and Sd corresponding to the colors (K, C, M, and Y), respectively. The image stations Sa, Sb, Sc, and Sd have substantially the same structure. In the present embodiment, the K, C, M, and Y image stations are arranged in this order from the upstream of the rotation direction of the intermediate transfer belt 7. However, the order in which the image stations are arranged is not limited to this, and may be appropriately changed.

The photosensitive drums 3*a* to 3*d* are disposed in an upper portion of the image forming apparatus 100. Moreover, the electricity-removing devices 5*a* to 5*d*, the charging devices 6*a* to 6*d*, the exposure units 1*a* to 1*d*, the developing device 2*a* to 2*d*, the cleaner units 4*a* to 4*d* are disposed around the photosensitive drums 3*a* to 3*d* along the rotation direction (indicated by an arrow in FIG. 1) of the photosensitive drums 3*a* to 3*d*, respectively.

The electricity-removing devices 5*a* to 5*d* are electricity-removing means for removing electricity from surfaces of the photosensitive drums 3*a* to 3*d*, respectively. The electricity-removing devices 5*a* to 5*d* are not particularly limited in term of their structures, and may be various electricity-removing devices that have been conventionally publicly known.

The charging devices 6*a* to 6*d* are charging means for uniformly charging the surfaces of the photosensitive drums 3*a* to 3*d* so that the surfaces of the photosensitive drums 3*a* to 3*d* have predetermined potentials, respectively. The charging devices 6*a* to 6*d* are not particularly limited in terms of their structures, and may be either noncontact chargers such as corona discharge chargers or contact-type chargers such as roller- or brush-type chargers.

The exposure units 1*a* to 1*d* expose, in accordance with input image data, the photosensitive drums 3*a* to 3*d* charged by the charging devices 6*a* to 6*d*, thereby forming electrostatic latent images on the surfaces of the photosensitive drums 3*a* to 3*d* in accordance with the image data, respectively. The exposure units 1*a* to 1*d* are not particularly limited in terms of their structures, and may each be either a laser scanning unit (LSU) including a laser irradiation section and a reflecting mirror or an EL or LED writing head including light-emitting elements arranged in an array manner.

The developing devices 2*a* to 2*d* performs a developing process of visualizing, with black (K) toner, cyan (C) toner, magenta (M) toner, and yellow (Y) toner, the electrostatic latent images formed on the photoreceptor drums 3*a* to 3*d*, respectively.

The cleaner units 4*a* to 4*d* remove and collect toner remaining on the surfaces of the photosensitive drums 3*a* to 3*d* after the development and the image transfer, respectively.

In the intermediate transfer belt unit 8, toner images respectively formed on the photosensitive drums 3*a* to 3*d* so as to have their respective colors are sequentially transferred onto the intermediate transfer belt 7 so as to be superimposed onto one another, with the result that that a color toner image (multicolor toner image) is formed on the intermediate transfer belt 7. Then, the toner image formed on the intermediate transfer belt 7 is conveyed to a location of contact between a recording paper sheet P and the intermediate transfer belt 7 by rotating the intermediate transfer belt 7, and then is transferred onto the recording paper sheet P.

As shown in FIG. 1, the intermediate transfer belt unit 8 includes intermediate transfer rollers 23*a* to 23*d*, the intermediate transfer belt 7, an intermediate transfer belt driving roller 21, a driven roller 22 that is driven by the intermediate transfer belt 7 to rotate, a second transfer roller 24, and a cleaning unit 25. The intermediate transfer belt 7 is tensioned between the intermediate transfer rollers 23*a* to 23*d*, the intermediate transfer belt driving roller 21, the driven roller 22 that is driven by the intermediate transfer belt 7 to rotate, and the like, and is driven to rotate in the direction of the arrow B.

Onto the intermediate transfer belt 7, toner images respectively formed on the photosensitive drums 3*a* to 3*d* so as to have their respective colors are sequentially transferred so as to be superimposed onto one another. With this, a color toner image (multicolor toner image) is formed on the intermediate transfer belt 7. The intermediate transfer belt 7 is an endless belt made of a film having a thickness of approximately 100 μm to 150 μm.

The toner images are transferred from the photosensitive drums 3*a* to 3*d* onto the intermediate transfer belt 7 by the intermediate transfer rollers 23*a* to 23*d* making contact with a backside of the intermediate transfer belt 7, respectively. The intermediate transfer rollers 23*a* to 23*d* are rotatably supported. The intermediate transfer rollers 23*a* to 23*d* give a high-voltage transfer bias (high voltage whose polarity (+) is reverse to the charging polarity (−) of the toner) for transferring, onto the intermediate transfer belt 7, the toner images respectively formed on the photosensitive drums 3*a* to 3*d*.

Each of the intermediate transfer rollers 23*a* to 23*d* has, as its base, a metal (e.g., stainless-steel) shaft having a diameter of 8 mm to 10 mm. Each of the intermediate transfer rollers 23*a* to 23*d* has a surface covered with an electrically-conductive elastic material (e.g., EPDM and urethane form). Such an electrically-conductive elastic material makes it possible to apply a high voltage uniformly to the intermediate transfer belt 7. In the present embodiment, the intermediate transfer rollers 23*a* to 23*d* are used as transfer electrodes. Instead, brushes may be used as transfer electrodes.

Thus, the electrostatic latent images (toner images) respectively visualized on the photosensitive drums 3*a* to 3*d* so as to correspond to their respective hues are transferred (stacked) onto the intermediate transfer belt 7, thereby forming an image corresponding to the image information inputted to the apparatus. The images thus transferred (stacked) is conveyed to the location of contact between the recording paper sheet P and the intermediate transfer belt 7 by rotating the intermediate transfer belt 7, and then is transferred onto the recording paper sheet P by the second transfer roller 24 disposed in the location of contact. Although described later in detail, the image forming apparatus 100 is such that the toner image transferred onto the intermediate transfer belt 7 and having yet to be conveyed to the location of contact between the recording paper sheet P and the intermediate transfer belt 7 is substantially uniformly charged by a charge imparting device 11.

Further, the toner remaining on the intermediate transfer belt 7 instead of being transferred onto the recording paper sheet P causes a toner color mixture in the next step. Therefore, the toner is removed and collected by the cleaning unit 25. The cleaning unit 25 includes a cleaning member, and brings the cleaning member into contact with the intermediate transfer belt 7, thereby removing and collecting the toner remaining on the intermediate transfer belt 7.

Provided below the intermediate transfer belt unit 8 is the paper sheet conveyer belt unit 10. The paper sheet conveyer belt unit 10 includes a driving roller 31, a driven roller 32 that is driven by the paper sheet conveyer belt 9 to rotate, a second transfer roller 33, a driven roller 34 that is driven by the paper sheet conveyer belt 9 to rotate, and the paper sheet conveyer belt 9. The paper sheet conveyer belt 9 is tensioned between these rollers, and is driven to rotate in the direction of the arrow C.

The second transfer roller 33 is used for transferring, onto a recording paper sheet P supplied to the paper sheet conveyer belt 9 from a paper feed mechanism (not shown) and being conveyed by the paper sheet conveyer belt 9, the toner image transferred onto the intermediate transfer belt 7.

Note that the image forming apparatus 100 is provided with the paper sheet conveying path S through which a recording paper sheet P stored in a paper feed tray (not shown) is sent to a paper ejection tray (not shown) via the paper sheet conveyer belt unit 10 and the fixing unit 12. Disposed near the paper sheet conveying path S extending from the paper feed tray to the paper ejection tray are a pickup roller (not shown), a registration roller 13, the second transfer rollers 24 and 33, the fixing unit 12, a conveyer roller (not shown) for conveying a recording paper sheet P, and the like. The conveyer roller is a small roller for facilitating/assisting the conveyance of a recording paper sheet P, and a plurality of such conveyer rollers are provided along the paper sheet conveying path S. The pickup roller is a feeding roller provided on that end of the paper feed tray from which a paper sheet is taken out, and supplies recording paper sheets P one by one to the paper sheet conveying path S. The registration roller 13 temporarily holds a recording paper sheet P being conveyed via the paper sheet conveying path S. The registration roller 13 supplies the recording paper sheet P onto the paper sheet conveyer belt 9 at such a timing that the head of the recording paper sheet P is aligned with the head of the toner image formed on the intermediate transfer belt 7.

The second transfer roller 24 of the intermediate transfer belt unit 8 and the second transfer roller 33 of the paper sheet conveyer belt unit 10 are pressed against each other via the intermediate transfer belt 7, the recording paper sheet P, and the paper sheet conveyer belt 9 with a predetermined nip (a predetermined pressure and a predetermined nip width). Applied to the second transfer roller 33 is a voltage (high voltage whose polarity (+) is reverse to the charging polarity (−) of the toner) by which the toner is transferred onto the recording paper sheet P. In order to constantly obtain the nip, it is preferable that while either one of the second transfer rollers 24 and 33 is made of a hard material (e.g., metal), the other be made of a soft material (e.g., elastic rubber or resin foam).

Although described below in detail, the image forming apparatus 100 includes the charge imparting device 11 that imparts charge to the paper sheet conveyer belt 9 onto which a recording paper sheet P has not been supplied from the paper feed mechanism (not shown), thereby removing (initializing) the residual potential of the paper sheet conveyer belt 9.

The fixing unit 12 is provided on a downstream side of the direction in which a paper sheet is conveyed by the paper sheet conveyer belt unit 10, and is used for fixing, onto a recording paper sheet P, a toner image transferred onto the recording paper sheet P.

The following describes the charge imparting device 11. As shown in FIG. 1, the charge imparting device 11 includes an ion generating section 40, a common duct 41, a duct 42 for the paper sheet conveyer belt (such a duct being elsewhere referred to as "paper sheet conveyer belt duct"), a duct 43 for the intermediate transfer belt (such a duct being elsewhere referred to as "intermediate transfer belt duct"), a nozzle 44 for the paper sheet conveyer belt (such a nozzle being elsewhere referred to as "paper sheet conveyer belt nozzle"), a nozzle 45 for the intermediate transfer belt (such a nozzle being elsewhere referred to as "intermediate transfer belt nozzle"), an air volume control plate 46, and a fan 47.

The ion generating section 40 includes an ion generating tank 50, a first electrode 51, a second electrode 52, and a power supply 53. The first electrode 51 and the second electrode 52 are disposed in the ion generating tank 50 so as to face each other. Moreover, when the power supply 53 applies a voltage between the first electrode 51 and the second electrode 52, an electric field is formed between these electrodes. This electric field causes molecules (such as oxygen molecules, nitrogen molecules, and carbon dioxide molecules) contained in the air near the electrodes to be separated into positive ions and electrons. Then, those electrons bond with molecules contained in the air (electron attachment), thereby forming negative ions (charged particles). Note that the size of a voltage to be applied between the first electrode 51 and the second electrode 52 is controlled by an after-mentioned control section 70 so that a predetermined amount of ions (charged particles) are generated.

Note that the first electrode 51 and the second electrode 52 are not particularly limited in terms of their material, shape, disposition, and the like as long as ions can be generated by applying a voltage between these electrodes. For example, the first electrode 51 and the second electrode 52 may be needle electrodes, serrated electrodes, pectinate electrodes, or the like. Further, the ion generating section 40 is not particularly limited in terms of its arrangement as long as it is arranged to be able to generate ions for supplying a predetermined charge to the intermediate transfer belt 7 and the paper sheet conveyer belt 9.

The fan 47 sends, to the common duct 41, a stream of ions (air containing ions) generated in the ion generating tank 50. The stream of ions thus sent to the common duct 41 diverges into the paper sheet conveyer belt duct 42 and the intermediate transfer belt duct 43. Provided at a point of divergence between the paper sheet conveyer belt duct 42 and the intermediate transfer belt duct 43 is the air volume control plate 46 for changing the proportion of (i) the area of an opening between the common duct 41 and the paper sheet conveyer belt duct 42 to (ii) the area of an opening between the common duct 41 and the intermediate transfer belt duct 43. Moreover, the after-mentioned control section 70 controls the movement of the air volume control plate 46, thereby controlling the proportion of (a) a stream of ions flowing into the paper sheet conveyer belt duct 42 to (b) a stream of ions flowing into the intermediate transfer belt duct 43.

Figure 2:
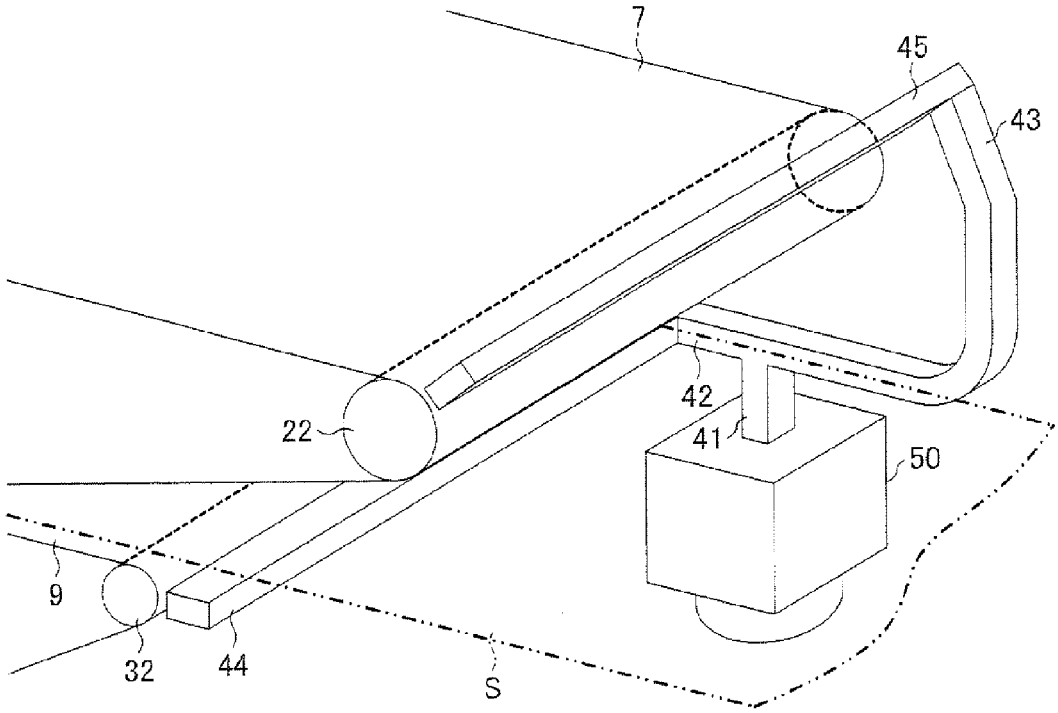
FIG. 2 is a perspective view showing the disposition of an intermediate transfer belt unit, a paper sheet conveyer belt unit, and an ion generating section in the image forming apparatus of FIG. 1.
Figure 3A:
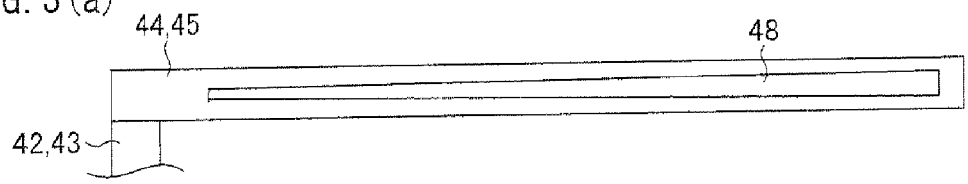
FIG. 3(*a*) is a plan view of a paper sheet conveyer belt nozzle and an intermediate transfer belt nozzle of a charge imparting device provided in the image forming apparatus of FIG. 1.
Figure 3B:
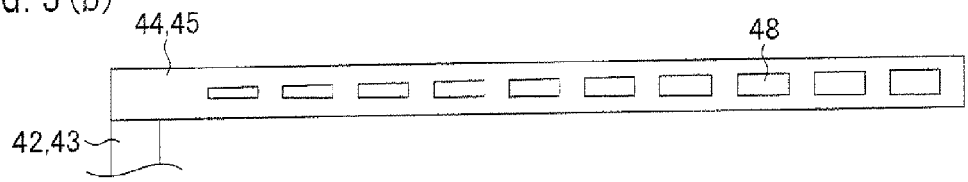
Figure 3C:
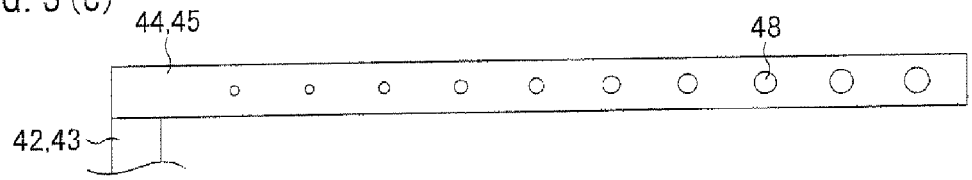
Figure 3D:
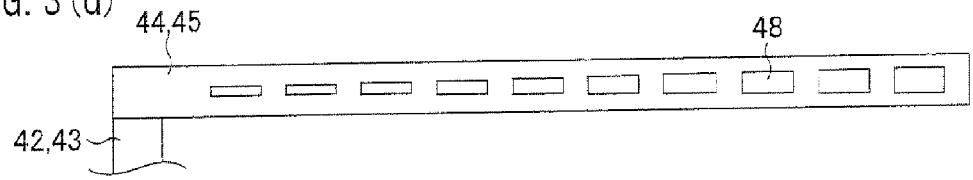
Figure 3E:
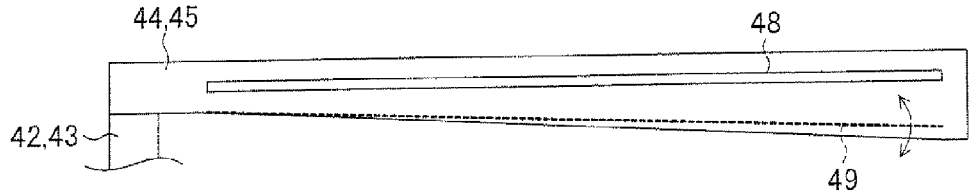

FIG. 2 is a perspective view showing the disposition of the intermediate transfer belt unit 8, the paper sheet conveyer belt unit 10, and the ion generating section 40. As shown in FIG. 2, the common duct 41, the paper sheet conveyer belt duct 42, and the intermediate transfer belt duct 43 of the ion generating section 40 are disposed farther away from this side of the image forming apparatus 100 than the paper sheet conveying path S so as to keep away from the paper sheet conveying path S.

FIG. 3(*a*) is a plan view of the intermediate transfer belt nozzle 45 as seen from the intermediate transfer belt 7. The following describes a structure of the intermediate transfer belt nozzle 45. Note that the paper sheet conveyer belt nozzle 44 has substantially the same structure as the intermediate transfer belt nozzle 45.

The intermediate transfer belt nozzle 45 has a hollow shape extending along the width direction of the intermediate transfer belt 7 (i.e., along a direction perpendicular to the rotation direction of the intermediate transfer belt 7). Moreover, as shown in FIG. 3(*a*), the intermediate transfer belt nozzle 45 has an opening 48 provided so as to face the intermediate transfer belt 7. With this, the stream of ions supplied to the intermediate transfer belt nozzle 45 through the intermediate transfer belt duct 43 is discharged from the opening 48 so as to be supplied to the intermediate transfer belt 7, so that the intermediate transfer belt 7 is charged.

Further, the intermediate transfer belt duct 43 is disposed farther away from this side of the image forming apparatus 100 than the paper sheet conveying path S so as to keep away from the paper sheet conveying path S, and is connected to one end of the intermediate transfer belt nozzle 45. Moreover, the opening 48 becomes wider as it extends from a point of connection between the intermediate transfer belt duct 43 and the intermediate transfer belt nozzle 45 to the opposite end. With this, the stream of ions supplied to the intermediate transfer belt nozzle 45 from the intermediate transfer belt duct 43 is substantially uniformly discharged along the width direction of the intermediate transfer belt 7. Therefore, the toner on the intermediate transfer belt 7 is substantially uniformly charged regardless of the position in the width direction of the intermediate transfer belt 7.

Further, the intermediate transfer belt nozzle 45 is disposed in such a manner that a stream of ions is supplied from the intermediate transfer belt nozzle 45 to a toner image transferred onto the intermediate transfer belt 7 (i) in a region where the intermediate transfer belt makes contact with the intermediate transfer belt driven roller 22, and (ii) at such a position that a line normal to that surface of the intermediate transfer belt 7 onto which a toner image is transferred is directed upward from the horizontal direction to the vertical direction (more specifically, at such a position that the normal line is at an angle of 45 degrees to the horizontal direction).

Figure 4:
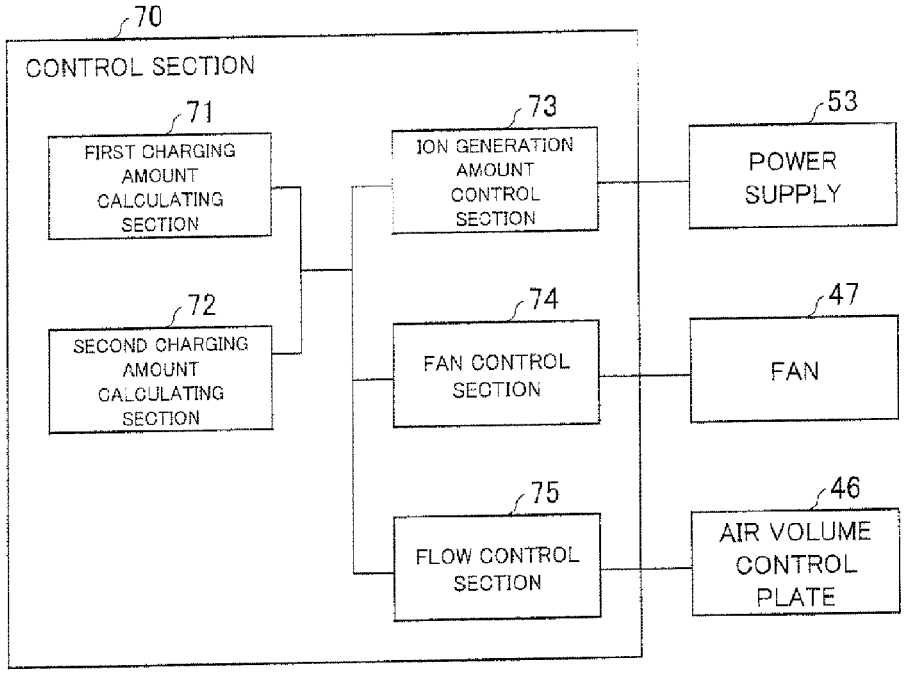
FIG. 4 is a block diagram showing a structure of a control section for controlling the operation of a charge imparting device provided in an image forming apparatus.

FIG. 4 is a block diagram showing a structure of the control section 70. As shown in FIG. 4, the control section 70 includes a first charging amount calculating section 71, a second charging amount calculating section 72, an ion generation amount control section 73, a fan control section 74, and a flow control section 75.

The first charging amount calculating section 71 calculates an amount of charge to be supplied from the intermediate transfer belt nozzle 45 to a toner image, transferred onto the intermediate transfer belt 7, so that the toner image on the intermediate transfer belt 7 has a predetermined potential at a point where the second transfer rollers 24 and 33 face each other.

Figure 5:
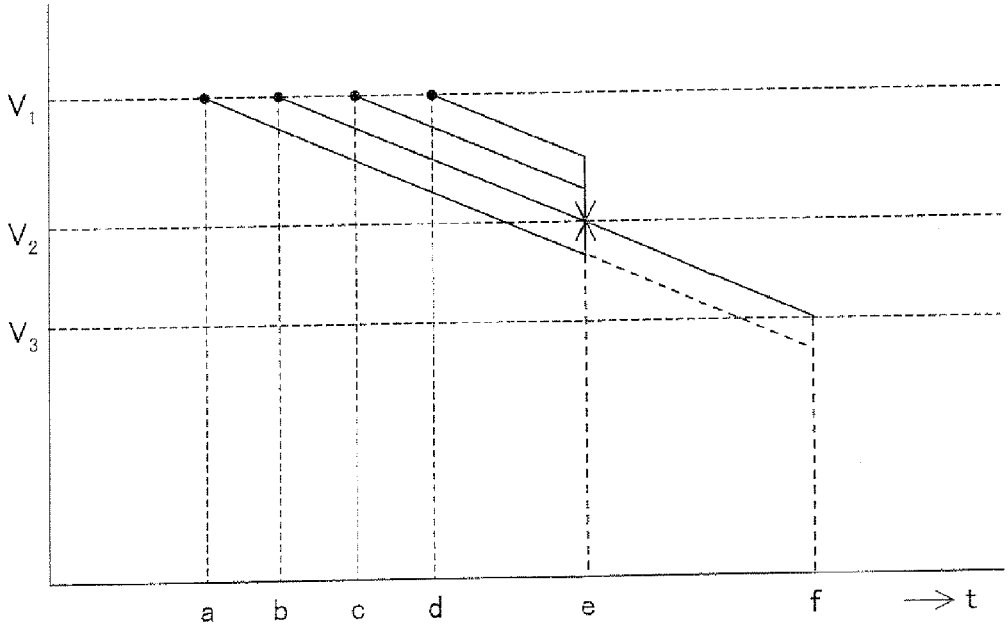
FIG. 5 is a graph showing a change in potential of toner on an intermediate transfer belt provided in an image forming apparatus.

FIG. 5 is a graph showing how the position of a toner image transferred onto the intermediate transfer belt 7 is related to the charging potential. As shown in FIG. 5, black toner, cyan toner, magenta toner, and yellow toner each having a potential V1 are transferred at a point a of contact between the intermediate transfer belt 7 and the photosensitive drum 3*a*, a point b of contact between the intermediate transfer belt 7 and the photosensitive drum 3*b*, a point c of contact between the intermediate transfer belt 7 and the photosensitive drum 3*c*, and a point d of contact between the intermediate transfer belt 7 and the photosensitive drum 3*d*, respectively. However, the black toner, the cyan toner, the magenta toner, and the yellow toner each transferred onto the intermediate transfer belt 7 have different potentials by the time they reach a point e where they face the intermediate transfer belt nozzle 45.

The first charging amount calculating section 71 calculates an amount of charge to be supplied from the intermediate transfer belt nozzle 45 to the toner image, transferred onto the intermediate transfer belt 7, so that the black toner, the cyan toner, the magenta toner, and the yellow toner have a potential V2. The potential V2 is such a potential that the toner on the intermediate transfer belt 7 has a potential V3 at a point f where the second transfer rollers 24 and 33 face each other. Further, the potential V3 is set such that the potential of the toner on the intermediate transfer belt 7 at the point f is reverse to a transfer bias potential that is imparted to the second transfer roller 33, and that the absolute value of the potential of the intermediate transfer belt 7 having passed through the point f and having reached the point a of contact between the intermediate transfer belt 7 and the photosensitive drum 3*a* is smaller than a transfer bias potential that is imparted to the intermediate transfer roller 23*a*. Note that the potentials V2 and V3 are preferably set so that the toner on the intermediate transfer belt 7 clings to the intermediate transfer belt 7 to such an extent that the toner neither drops nor scatters even when the intermediate transfer belt 7 is, for example, vibrated due to the conveyance before the toner reaches the point f after having passed through the point e.

The image forming apparatus 100 allows users to use an operation panel (not shown) or the like to switch between a monochrome mode of forming a monochrome image and a color mode of forming a multicolor image. Moreover, the first charging amount calculating section 71 calculates, for each of the monochrome mode and the color mode, a potential that is to be imparted to the toner on the intermediate transfer belt 7 at each of the points of contact a to d. Further, the first charging amount calculating section 71 calculates, in consideration of the distance between each of the points of contact a to d and the point e, an amount of charge that is to be supplied from the intermediate transfer belt nozzle 45 to the toner image transferred onto the intermediate transfer belt 7.

The second charging amount calculating section 72 calculates an amount of charge to be supplied to the paper sheet conveyer belt 9 so that the residual potential of the paper sheet conveyer belt 9 is removed (initialized).

The ion generation amount control section 73 controls the value of voltage that is applied between the first electrode 51 and the second electrode 52 by the power supply 53, and controls an amount of ions that are generated in the ion generating section 40. Specifically, the ion generation amount control section 73 controls the ion generation amount of the ion generating section 40 so that ions are generated so as to correspond to the amounts of charge respectively calculated by the first charge amount calculating section 71 and the second charge amount calculating section 72. In cases where there occurs an ion loss in each duct, the amount of ions that are generated in the ion generating section 40 may be controlled in consideration of the amount of ions lost.

The fan control section 74 controls the speed of rotation of the fan 47, thereby controlling an amount of air that is sent to the ion generating section 40.

The flow control section 75 controls the angle of the air volume control plate 46, thereby controlling the proportion of (i) a stream of ions flowing into the paper sheet conveyer belt duct 42 to (ii) a stream of ions flowing into the intermediate transfer belt duct 43. Specifically, the flow control section 75 controls the angle of the air volume control plate 46 so that the streams of ions corresponding to the amounts of charge calculated by the first charge amount calculating section 71 and the second charge amount calculating section 72 are guided to the intermediate transfer belt nozzle 45 and the paper sheet conveyer belt nozzle 44, respectively.

As described above, the image forming apparatus 100 according to the present embodiment includes a charge imparting device 11 which includes: an intermediate transfer belt nozzle 45 for imparting charge to a toner image, formed on the intermediate transfer belt by toner images respectively transferred from the photosensitive drums 3*a* to 3*d*, which has yet to be transferred onto a recording paper sheet P; and a paper sheet conveyer belt nozzle 44 for imparting charge to the paper sheet conveyer belt 9.

For this reason, as compared with an arrangement in which a device for imparting charge to a toner image transferred onto an intermediate transfer belt and a device for imparting charge to a paper sheet conveyer belt are separately provided, it is possible to reduce the size of the image forming apparatus 100 and the amount of power to be consumed by the image forming apparatus 100.

Further, the intermediate transfer belt nozzle 45 is disposed in such a manner that a stream of ions is supplied from the intermediate transfer belt nozzle 45 to a toner image transferred onto the intermediate transfer belt 7 in a region where the intermediate transfer belt 7 makes contact with the intermediate transfer belt driven roller 22. This makes it possible to impart charge to the region of contact between the intermediate transfer belt 7 and the intermediate transfer belt driven roller 22, i.e., to a region where the belt is inhibited from being vibrated. Therefore, the toner image on the intermediate transfer belt 7 can be substantially uniformly charged regardless of the position in the width direction of the belt. Similarly, the paper sheet conveyer belt nozzle 44 supplies a stream of ions to the paper sheet conveyer belt 9 in a region where the paper sheet conveyer belt 9 makes contact with the driven roller 32, and therefore can impart charge substantially uniformly to the paper sheet conveyer belt 9 regardless of the position in the width direction of the paper sheet conveyer belt 9.

Further, the intermediate transfer belt 7 is disposed so that toner images are respectively transferred from the photosensitive drums 3*a* to 3*d* onto the intermediate transfer belt 7 at such a position that a line normal to that surface of the intermediate transfer belt 7 on which the toner images are transferred is directed upward from the horizontal direction to the vertical direction. The intermediate transfer belt nozzle 45 is disposed so as to supply a stream of ions (charge) to the intermediate transfer belt 7 before a line normal to that surface of the intermediate transfer belt 7 onto which a toner image has been transferred is directed downward from the horizontal direction to the vertical direction. This makes it possible to impart charge to a toner image, transferred onto the intermediate transfer belt 7, before the toner image faces downward from the horizontal direction to the vertical direction, thereby causing the toner to better cling to the intermediate transfer belt 7. This makes it possible to prevent the toner from dropping or scattering from the intermediate transfer belt 7.

Note that as the angle at which a line normal to that surface of the intermediate transfer belt 7 onto which a toner image is transferred is tilted to the horizontal direction when the intermediate transfer belt nozzle 45 imparts charge to the toner image becomes larger (approximately 90 degrees), the shear force generated between the intermediate transfer belt 7 and the toner image due to the gravity that acts on the toner image transferred onto the intermediate transfer belt 7 becomes smaller. For this reason, in order to prevent the toner from dropping or scattering from the intermediate transfer belt 7, it is preferable to impart charge to the toner image at such a position that a line normal to that surface of the intermediate transfer belt 7 onto which the toner image is transferred is at a large angle (of approximately 90 degrees) to the horizontal direction. Specifically, it is preferable to impart charge to the toner image at such a position that a line normal to that surface of the intermediate transfer belt 7 onto which the toner image is transferred is at an angle of not less than 30 degrees to not more than 90 degrees, more preferably not less than 45 degrees to not more than 90 degrees, or even more preferably not less than 60 degrees to not more than 90 degrees, to the horizontal direction.

Further, in cases where the intermediate transfer belt nozzle 45 supplies a stream of ions to a toner image, transferred onto the intermediate transfer belt 7, in a region where the intermediate transfer belt 7 makes contact with the driven roller 22, a smaller angle at which a line normal to that surface of the intermediate transfer belt 7 onto which the toner image is transferred is tilted to the horizontal direction means that the space above the driven roller 22 becomes wider. Moreover, the disposition of members such as image stations or part of those members in the space makes it possible to reduce the size of the image forming apparatus 100. Further, the disposition of members such as image stations or part of these members in the space makes it possible to shorten the intermediate transfer belt 7. With this, the amount of charge to be imparted from the intermediate transfer belt nozzle 45 can be reduced by inhibiting a decrease in charging potential of the toner image transferred onto the intermediate transfer belt 7. This makes it possible to reduce power consumption. In order to prevent the toner from dropping and scattering, to reduce the size of the image forming apparatus 100, and to reduce power that is to be consumed by the image forming apparatus 100, it is preferable that the intermediate transfer belt nozzle 45 be disposed so as to impart charge to a toner image at such a position that a line normal to that surface of the intermediate transfer belt 7 onto which the toner image is transferred be tilted at an angle of not less than 0 degree to less than 90 degrees, or more preferably not less than 0 degree to not more than 60 degrees, to the horizontal direction.

Further, the present embodiment has described an arrangement in which the paper sheet conveyer belt 9 is rid of residual charge by charging the paper sheet conveyer belt 9 with use of a stream of ions discharged from the paper sheet conveyer belt nozzle 44. However, the present technology is not limited to this. For example, a stream of ions discharged from the paper sheet conveyer belt nozzle 44 may be used to impart charge for causing a recording paper sheet P to electrostatically cling to the paper sheet conveyer belt 9. In this case, the second charging amount calculating section 72 calculates, in accordance with the material, thickness, and the like of a recording paper sheet P to be conveyed, a potential for causing the recording paper sheet P to electrostatically cling to the paper sheet conveyer belt 9. With this, the recording paper sheet P can be conveyed so as to face the intermediate transfer belt 7 while electrostatically clinging to the paper sheet conveyer belt 9. This makes it possible to prevent printing misalignment from being caused, for example, by floating of the recording paper sheet P.

Further, in the present embodiment, the paper sheet conveyer belt nozzle 44 includes a hollow member extending in the width direction of the paper sheet conveyer belt 9. The hollow member has an opening provided so as to face the paper sheet conveyer belt 9. The opening is shaped such that the opening ratio varies depending on the distance from a point of connection between the paper sheet conveyer belt nozzle 44 and the paper sheet conveyer belt duct 42. Similarly, the intermediate transfer belt nozzle 45 includes a hollow member extending in the width direction of the intermediate transfer belt 7. The hollow member has an opening provided so as to face the intermediate transfer belt 7. The opening is shaped such that the opening ratio varies depending on the distance from a point of connection between the intermediate transfer belt nozzle 45 and the intermediate transfer belt duct 43. This makes it possible to uniformly discharge a stream of ions regardless of the position in the width directions of the paper sheet conveyer belt 9 and the intermediate transfer belt 7.

Note that the arrangements of the paper sheet conveyer belt nozzle 44 and the intermediate transfer belt nozzle 45 are not limited to the arrangement shown in FIG. 3(*a*). However, it is preferable that the paper sheet conveyer belt nozzle 44 and the intermediate transfer belt nozzle 45 be arranged to substantially uniformly charge the paper sheet conveyer belt 9 and the intermediate transfer belt 7 regardless of the position in the width directions of the paper sheet conveyer belt 9 and the intermediate transfer belt 7 by substantially uniformly discharging streams of ions along the width directions of the paper sheet conveyer belt 9 and the intermediate transfer belt 7, respectively.

For example, as shown in FIG. 3(*b*), there may be provided a plurality of trapezoidal openings 48 each of which is wider than the previous one as the intermediate transfer belt nozzle 45 (the paper sheet conveyer belt nozzle 44) extends to its end opposite a point of connection between the intermediate transfer belt nozzle 45 (the paper sheet conveyer belt nozzle 44) and the intermediate transfer belt duct 43 (the paper sheet conveyer belt duct 42).

Further, as shown in FIG. 3(*c*), there may be provided a plurality of elliptical openings 48 each of which is wider than the previous one as the intermediate transfer belt nozzle 45 (the paper sheet conveyer belt nozzle 44) extends to its end opposite a point of connection between the intermediate transfer belt nozzle 45 (the paper sheet conveyer belt nozzle 44) and the intermediate transfer belt duct 43 (the paper sheet conveyer belt duct 42).

Further, as shown in FIG. 3(*d*), there may be provided a plurality of rectangular openings 48 each of which is wider than the previous one as the intermediate transfer belt nozzle 45 (the paper sheet conveyer belt nozzle 44) extends to its end opposite a point of connection between the intermediate transfer belt nozzle 45 (the paper sheet conveyer belt nozzle 44) and the intermediate transfer belt duct 43 (the paper sheet conveyer belt duct 42).

Further, as shown in FIG. 3(*d*), the intermediate transfer belt nozzle 45 (the paper sheet conveyer belt nozzle 44) may be shaped so as to have a cross-sectional area that becomes wider as the intermediate transfer belt nozzle 45 (the paper sheet conveyer belt nozzle 44) extends to its end opposite a point of connection with the intermediate transfer belt duct 43 (the paper sheet conveyer belt duct 42), and may have an opening 48 whose shape is constant regardless of the position in the longitudinal direction of the intermediate transfer belt nozzle 45 (the paper sheet conveyer belt nozzle 44). In this case, it is only necessary that the rate of change at which the cross-sectional area of a cross-sectional surface perpendicular to the longitudinal direction of the intermediate transfer belt nozzle 45 (the paper sheet conveyer belt nozzle 44) is changed with respect to the longitudinal direction of the intermediate transfer belt nozzle 45 (the paper sheet conveyer belt nozzle 44) be appropriately set so that a stream of ions can be substantially uniformly discharged along the width direction of the intermediate transfer belt 7 (the paper sheet conveyer belt 9). Further, as indicated by a dotted line in FIG. 3(*e*), the intermediate transfer belt nozzle 45 (the paper sheet conveyer belt nozzle 44) may be provided with a movable plate 49 for causing the cross-sectional area to be variable, and the rate of change may be controlled by the control section 70 controlling the movement of the movable plate 49.

Further, although the present embodiment has described the image forming apparatus 100 arranged such that toner images respectively having a plurality of colors are transferred onto the intermediate transfer belt 7 so as to be superimposed onto one another, the present technology is not limited to this. For example, the present technology may be applied to an image forming apparatus that forms a monochrome image.

Further, each of the blocks of the control section 70 provided in the image forming apparatus 100 is constituted by software with use of a processor such as a CPU. That is, the image forming apparatus 100 has: (i) the CPU (central processing unit) for executing an instruction of control program realizing various functions; (ii) a ROM (read only memory) storing the program; (iii) a RAM (random access memory) for expanding the program; (iv) a storage device (storage medium) such as a memory storing the program and various data; and (v) the like. The object of the present technology also can be achieved by (i) providing, for the image forming apparatus 100, a storage medium storing, in a computer readable manner, a program code (executable program; intermediate code; source program) of the control program for the present system, and (ii) causing a computer (CPU or MPU) to read and execute the program code stored in the storage medium, the program code being the software realizing the aforementioned functions.

Examples of the storage medium are: (i) tapes such as a magnetic tape and a cassette tape; (ii) magnetic disks such as a Floppy® disk and a hard disk; (iii) optical disks such as a compact disk read only memory (CD-ROM), a magnetic optical disk (MO), a mini disk (MD), a digital video disk (DVD), and a CD-Rewritable (CD-R); (iv) cards such as an IC card (inclusive of a memory card) and an optical card; and (v) semiconductor memories such as a mask ROM, an EPROM (electrically programmable read only memory), an EEPROM (electrically erasable programmable read only memory), and a flash ROM.

Further, the image forming apparatus 100 may be connectable to the communication network, and the program code may be supplied via the communication network. The communication network is not particularly limited. Specific examples thereof are: the Internet, Intranet, Extranet, LAN (local area network), ISDN (integrated services digital network), VAN (value added network), CATV (cable TV) communication network, virtual private network, telephone network, mobile communication network, satellite communication network, and the like. Further, the transmission medium constituting the communication network is not particularly limited. Specific examples thereof are: (i) a wired channel using an IEEE 1394, a USB (universal serial bus), a power-line communication, a cable TV line, a telephone line, an ADSL line, or the like; or (ii) a wireless communication using IrDA, infrared rays used for a remote controller, Bluetooth®, IEEE 802.11, HDR (High Data Rate), a mobile phone network, a satellite connection, a terrestrial digital network, or the like. Note that, the present technology can be realized by (i) a carrier wave realized by electronic transmission of the program code, or (ii) a form of a series of data signals.

Further, each of the blocks of the control section 70 does not need to be realized with use of software, and may be constituted by hardware logic.

In order to solve the foregoing problems, an image forming apparatus includes (i) a photoreceptor for carrying a toner image, (ii) an intermediate transfer body onto which the toner image is transferred from the photoreceptor, and (iii) recording material conveying means for supporting a recording material and conveying the recording material to a point where the recording material conveying means faces the intermediate transfer body, and transfers the toner image from the intermediate transfer body onto the recording material at the point, the image forming apparatus comprising a charge imparting device which includes (a) an ion generating section for generating ions, (b) a first imparting section for imparting charge, with use of the ions generated by the ion generating section, to the toner image transferred onto the intermediate transfer body and having yet to be transferred from the intermediate transfer body onto the recording material, and (c) a second imparting section for imparting charge to the recording material conveying means with use of the ions generated by the ion generating section.

According to the foregoing arrangement, the image forming apparatus has a charge imparting device which includes (a) an ion generating section for generating ions, (b) a first imparting section for imparting charge, with use of the ions generated by the ion generating section, to the toner image having yet to be transferred from the intermediate transfer body onto the recording material, and (c) a second imparting section for imparting charge to the recording material conveying means with use of the ions generated by the ion generating section. That is, both the toner image transferred onto the intermediate transfer body and the recording material conveying means are charged with use of the ions generated by the common ion generating section. Therefore, as compared with an arrangement in which a charge generating device for charging the toner image transferred onto an intermediate transfer body and a charge generating device for the charging recording material conveying means are separately provided, it is possible to reduce the size of the image forming apparatus and the amount of power to be consumed by the image forming apparatus. Further, the characteristics of the toner image being transferred from the intermediate transfer body onto the recording material can be stabilized by uniformly charging the toner image transferred onto the intermediate transfer body. Further, when the toner image transferred onto the intermediate transfer body and having yet to be transferred from the intermediate transfer body onto the recording material is charged so as to better cling to the intermediate transfer body, the toner image transferred on the intermediate transfer body can be prevented from dropping or scattering from the intermediate transfer body. Further, the recording material can be stably conveyed by imparting, to the recording material conveying means, charge for ridding the recording material conveying means of residual charge or charge for causing the recording material to electrostatically cling to the recoding material conveying means.

Further, the image forming apparatus may be arranged such that: the charge imparting device includes (i) a first duct through which the ions generated by the ion generating section are supplied to the first imparting section and (ii) a second duct through which the ions generated by the ion generating section are supplied to the second imparting section; the first imparting section discharges, toward the toner image transferred onto the intermediate transfer body, the ions supplied from the ion generating section; and the second imparting section discharges, toward the recording material conveying means, the ions supplied from the ion generating section.

According to the foregoing arrangement, the ions generated by the ion generating section can be discharged from the first imparting section and the second imparting section to the toner image transferred onto the intermediate transfer body and the recording material conveying means, respectively. Therefore, the toner image transferred onto the intermediate transfer body and the recording material conveying means can be charged with use of the common ion generating section. This makes it possible to reduce the size of the image forming apparatus and the amount of power to be consumed by the image forming apparatus.

Further, the image forming apparatus may be arranged such that: the intermediate transfer body includes a belt member tensioned between a plurality of roller members; and the first imparting section substantially uniformly discharges, in a width direction of the belt member, the ions supplied from the ion generating section. The term "substantially uniformly" here means that the ions do not need to be strictly uniformly discharged but may be practically uniformly discharged. Specifically, it is only necessary that the difference between the maximum discharge rate and the minimum discharge rate at each position in the width direction be within 5% with respect to the maximum discharge rate.

[According to the foregoing arrangement, the toner image on the belt member can be charged regardless of the position in the width direction of the belt member.

Further, the image forming apparatus may be arranged such that: the intermediate transfer body includes a belt member tensioned between a plurality of roller members; and the first imparting section includes (i) a hollow member extending in a width direction of the belt member, (ii) an introducing section through which the ions supplied through the first duct are introduced into the hollow member, and (iii) an opening provided in the hollow member so as to face the belt member.

According to the foregoing arrangement, the toner image on the belt member can be charged by discharging the ions from the opening.

Further, the image forming apparatus may be arranged such that: the recording material conveying means includes a conveyer belt tensioned between a plurality of supporting rollers; and the second imparting section substantially uniformly discharges, in a width direction of the conveyer belt, the ions supplied from the ion generating section.

According to the foregoing arrangement, the ions can be substantially uniformly discharged to the conveyer belt regardless of the position in the width direction of the conveyer belt.

Further, the image forming apparatus may be arranged such that: the recording material conveying means includes a conveyer belt tensioned between a plurality of supporting rollers; and the second imparting section includes (i) a hollow member extending in a width direction of the conveyer belt, (ii) an introducing section through which the ions supplied through the second duct are introduced into the hollow member, and (iii) an opening provided in the hollow member so as to face the conveyer belt.

According to the foregoing arrangement, the conveyer belt can be charged by discharging the ions from the opening.

Further, the image forming apparatus may be arranged such that: the opening of each of the first imparting section and the second imparting section has a shape whose width varies in a direction perpendicular to an extending direction of the hollow member in accordance with a distance from the introducing section along the extending direction.

According to the foregoing arrangement, by appropriately setting the width of the opening at each position in the extending direction, the ions supplied from the ion generating section to each discharging section can be substantially uniformly discharged along the extending direction. With this, the toner image on the belt member, or the conveyer belt, can be substantially uniformly charged regardless of the position in the width direction.

Further, the image forming apparatus may be arranged such that: the intermediate transfer body includes a belt member tensioned between a plurality of roller members; and the first imparting section imparts charge, in a region where the belt member makes contact with one of the roller members, to the toner image transferred onto the intermediate transfer body.

In the region where the belt member makes contact with one of the roller members, the belt member is inhibited from being vibrated. For this reason, the foregoing arrangement makes it possible to prevent vibrations of the belt member from causing variations in electric charge that is imparted to the toner image transferred onto the belt member.

Further, the image forming apparatus may be arranged such that: the toner image is transferred onto the intermediate transfer body from the photoreceptor at a such position that a line normal to a surface of the belt member onto which surface the toner image is transferred is directed upward from a horizontal direction to a vertical direction; and after the toner image has been transferred from the photoreceptor onto the belt member, the first imparting section imparts charge, at such a position that a line normal to a surface of the belt member onto which surface the toner image has been transferred has not been directed downward from the horizontal direction to the vertical direction, to the toner image transferred onto the belt member.

According to the foregoing arrangement, the toner image is transferred onto the intermediate transfer body from the photoreceptor at a such position that a line normal to a surface of the belt member onto which surface the toner image is transferred is directed upward from a horizontal direction to a vertical direction; and the toner image transferred onto the belt member is charged at such a position that a line normal to a surface of the belt member onto which surface the toner image has been transferred has not been directed downward from the horizontal direction to the vertical direction. This makes it possible to charge a toner image having yet to face downward from the horizontal direction to the vertical direction, thereby causing the toner image to better cling to the intermediate transfer body. This makes it possible to prevent the toner from dropping or scattering from the intermediate transfer body. Therefore, the toner image transferred from the photoreceptor onto the intermediate transfer body can be appropriately transferred onto a recording material. This makes it possible to prevent deterioration in image quality. This also makes it possible to prevent the members of the image forming apparatus and the recording material from being stained with toner having dropped or scattered from the intermediate transfer body.

Further, the image forming apparatus may be arranged such that the second imparting section rids the recording material conveying means of residual charge by charging the recording material conveying means before the recording material conveying means supports the recording material.

The foregoing arrangement makes it possible to appropriately convey the recording material by ridding the recording material conveying means of residual charge before the recording material conveying means supports the recording material.

Further, the image forming apparatus may be arranged such that the second imparting section imparts charge to the recording material conveying means so as to cause the recording material to electrostatically cling to the recording material conveying means.

The foregoing arrangement makes it possible to convey the recording material having electrostatically clung to the recording material conveying means. This makes it possible to prevent printing misalignment from being caused, for example, by floating of the recording material.

Further, the image forming apparatus may be arranged such that: the recording material conveying means includes a conveyer belt tensioned between a plurality of supporting rollers; and the second imparting section imparts charge to the conveyer belt in a region where the conveyer belt makes contact with one of the supporting rollers.

In the region where the conveyer belt makes contact with one of the supporting rollers, the conveyer belt is inhibited from being vibrated. For this reason, the foregoing arrangement makes it possible to prevent vibrations of the conveyer belt from causing variations in electric charge that is imparted to the conveyer belt.

Further, the image forming apparatus may be arranged so as to include a plurality of photoreceptors by which toner images having a plurality of colors are transferred onto the intermediate transfer body, respectively, so as to be superimposed onto one another.

According to the foregoing arrangement, the toner images respectively having a plurality of colors are transferred onto the intermediate transfer body so as to be superimposed onto one another, and the toner images thus superimposed onto one another are transferred onto a recording material. This makes it possible to form a color image on the recording material. Further, according to the foregoing arrangement, even in cases where the toner images having their respective colors and transferred onto the intermediate transfer body have different charging potentials, the potentials of the toner images having their respective colors are equalized. This makes it possible to appropriately transfer the toner images onto the recording material. This also makes it possible to prevent the toner from dropping or scattering from the intermediate transfer body.

Further, the image forming apparatus may be arranged to further include a control section for controlling (i) an amount of charge to be imparted from the first imparting section to the toner image transferred onto the intermediate transfer body and (ii) an amount of charge to be imparted from the second imparting section to the recording material conveying means.

According to the foregoing arrangement, the control section controls (i) the amount of charge to be imparted from the first imparting section to the toner image transferred onto the intermediate transfer body and (ii) the amount of charge to be imparted from the second imparting section to the recording material conveying means. This makes it possible to appropriately control the potential of the toner image transferred onto the intermediate transfer body and the potential of the recording material conveying means.

Further, the image forming apparatus may be arranged such that: the charge imparting device includes (i) a first duct through which the ions generated by the ion generating section are guided to the first imparting section and (ii) a second duct through which the ions generated by the ion generating section are guided to the second imparting section; and the control section includes (a) a first calculating section for calculating an amount of charge to be imparted to the toner image so that the toner image is charged so as to have a predetermined potential, the toner image having been transferred from the image carrier onto the intermediate transfer body and having yet to be transferred from the intermediate transfer body onto the recording material, (b) a second calculating means for calculating an amount of charge to be imparted to the recording material conveying means so that the recording material conveying means is rid of residual charge, and (c) an ion generation amount control section for controlling, in accordance with a total of the amounts of charge respectively calculated by the first calculating section and the second calculating section, an amount of ions to be generated by the ion generating section. It should be noted here that the amount of ions to be generated may be an amount of ions corresponding to the total of the amounts of charge respectively calculated by the first calculating section and the second calculating section, or may be an amount obtained by adding, to the amount of ions corresponding to the total, an amount of ions lost via ion supply paths respectively extending from the ion generating section to the first imparting section and the second imparting section.

According to the foregoing arrangement, the first calculating section calculates the amount of charge to be imparted to the toner image so that the toner image is charged so as to have a predetermined potential, and the second calculating means calculates the amount of charge to be imparted to the recording material conveying means so that the recording material conveying means is rid of residual charge. Moreover, the ion generation amount control section controls, in accordance with a total of the amounts of charge respectively calculated by the first calculating section and the second calculating section, the amount of ions to be generated by the ion generating section. This makes it possible to appropriately control the amount of ions to be generated by the ion generating section. This makes it possible to prevent the toner transferred onto the intermediate transfer body from being insufficiently charged due to an insufficient amount of ion generation, and to prevent the recording material conveying means from being insufficiently rid of residual charge. This also makes it possible to reduce power consumption by preventing an excessive amount of ions from being generated.

Further, the image forming apparatus may be arranged to further include an opening switching section for switching a proportion of (i) an area of a first opening through which the ion generating section is communicated with the first duct to (ii) an area of a second opening through which the ion generating section is communicated with the second duct, wherein the control section includes a flow control section for, by controlling movement of the opening switching section in accordance with calculation results respectively yielded by the first calculating section and the second calculating section, switching a proportion of (a) an amount of ions to be supplied from the ion generating section to the first duct to (b) an amount of ions to be supplied from the ion generating section to the second duct.

According to the foregoing arrangement, the flow control section switches, by controlling the movement of the opening switching section in accordance with the calculation results respectively yielded by the first calculating section and the second calculating section, the proportion of (a) the amount of ions to be supplied from the ion generating section to the first duct to (b) the amount of ions to be supplied from the ion generating section to the second duct. This makes it possible to appropriately control charge to be imparted to the toner image transferred onto the intermediate transfer body and to the recording material conveying means.

The embodiments and concrete examples of implementation discussed in the foregoing detailed explanation serve solely to illustrate the technical details, which should not be narrowly interpreted within the limits of such embodiments and concrete examples, but rather may be applied in many variations within the spirit of the present technology, provided such variations do not exceed the scope of the patent claims set forth below.

What is claimed is:

1. An image forming apparatus, comprising:

a photoreceptor for carrying a toner image;

an intermediate transfer body onto which the toner image is transferred from the photoreceptor;

recording material conveying means for supporting a recording material and conveying the recording material to a transfer point where the recording material conveying means faces the intermediate transfer body, and wherein the toner image is transferred from the intermediate transfer body onto the recording material at the transfer point;

a charge imparting device which includes:

an ion generating section for generating ions, a first imparting section for imparting charge, with use of the ions generated by the ion generating section, to the toner image transferred onto the intermediate transfer body and having yet to be transferred from the intermediate transfer body onto the recording material, and a second imparting section for imparting charge to the recording material conveying means with use of the ions generated by the ion generating section; and a control section for controlling (i) an amount of charge to be imparted from the first imparting section to the toner image transferred onto the intermediate transfer body and (ii) an amount of charge to be imparted from the second imparting section to the recording material conveying means.

2. The image forming apparatus as set forth in claim 1, wherein:

the charge imparting device includes (i) a first duct through which the ions generated by the ion generating section are supplied to the first imparting section and (ii) a second duct through which the ions generated by the ion generating section are supplied to the second imparting section;

the first imparting section discharges, toward the toner image transferred onto the intermediate transfer body, the ions supplied from the ion generating section; and the second imparting section discharges, toward the recording material conveying means, the ions supplied from the ion generating section.

3. The image forming apparatus as set forth in claim 2, wherein:

the intermediate transfer body includes a belt member tensioned between a plurality of roller members; and the first imparting section substantially uniformly discharges, in a width direction of the belt member, the ions supplied from the ion generating section.

4. The image forming apparatus as set forth in claim 2, wherein:

the intermediate transfer body includes a belt member tensioned between a plurality of roller members; and the first imparting section includes (i) a hollow member extending in a width direction of the belt member, (ii) an introducing section through which the ions supplied through the first duct are introduced into the hollow member, and (iii) an opening provided in the hollow member so as to face the belt member.

5. The image forming apparatus as set forth in claim 2, wherein:

the recording material conveying means includes a conveyer belt tensioned between a plurality of supporting rollers; and the second imparting section substantially uniformly discharges, in a width direction of the conveyer belt, the ions supplied from the ion generating section.

6. The image forming apparatus as set forth in claim 2, wherein:

the recording material conveying means includes a conveyer belt tensioned between a plurality of supporting rollers; and the second imparting section includes (i) a hollow member extending in a width direction of the conveyer belt, (ii) an introducing section through which the ions supplied through the second duct are introduced into the hollow member, and (iii) an opening provided in the hollow member so as to face the conveyer belt.

7. The image forming apparatus as set forth in claim 4, wherein the opening has a shape whose width varies in a direction perpendicular to an extending direction of the hollow member in accordance with a distance from the introducing section along the extending direction.

8. The image forming apparatus as set forth in claim 6, wherein the opening has a shape whose width varies in a direction perpendicular to an extending direction of the hollow member in accordance with a distance from the introducing section along the extending direction.

9. The image forming apparatus as set forth in claim 1, wherein:

the intermediate transfer body includes a belt member tensioned between a plurality of roller members; and the first imparting section imparts charge, in a region where the belt member makes contact with one of the roller members, to the toner image transferred onto the intermediate transfer body.

10. The image forming apparatus as set forth in claim 1, wherein:

the intermediate transfer body includes a belt member, tensioned between a plurality of roller members, onto which the toner image is transferred from the photoreceptor at a such position that a line normal to a surface of the belt member onto which surface the toner image is transferred is directed upward from a horizontal direction to a vertical direction; and after the toner image has been transferred from the photoreceptor onto the belt member, the first imparting section imparts charge, at such a position that a line normal to a surface of the belt member onto which surface the toner image has been transferred has not been directed downward from the horizontal direction to the vertical direction, to the toner image transferred onto the belt member.

11. The image forming apparatus as set forth in claim 1, wherein the second imparting section rids the recording material conveying means of residual charge by charging the recording material conveying means before the recording material conveying means supports the recording material.

12. The image forming apparatus as set forth in claim 1, wherein the second imparting section imparts charge to the recording material conveying means so as to cause the recording material to electrostatically cling to the recording material conveying means.

13. The image forming apparatus as set forth in claim 1, wherein:

the recording material conveying means includes a conveyer belt tensioned between a plurality of supporting rollers; and the second imparting section imparts charge to the conveyer belt in a region where the conveyer belt makes contact with one of the supporting rollers.

14. The image forming apparatus as set forth in claim 1, wherein the image forming apparatus includes a plurality of photoreceptors by which toner images having a plurality of colors are transferred onto the intermediate transfer body, respectively, so as to be superimposed onto one another.

15. The image forming apparatus as set forth in claim 1, wherein:

the charge imparting device includes (i) a first duct through which the ions generated by the ion generating section are guided to the first imparting section and (ii) a second duct through which the ions generated by the ion generating section are guided to the second imparting section; and the control section includes (a) a first calculating section for calculating an amount of charge to be imparted to the toner image so that the toner image is charged so as to have a predetermined potential, the toner image having been transferred from the image carrier onto the intermediate transfer body and having yet to be transferred from the intermediate transfer body onto the recording material, (b) a second calculating means for calculating an amount of charge to be imparted to the recording material conveying means so that the recording material conveying means is rid of residual charge, and (c) an ion generation amount control section for controlling, in accordance with a total of the amounts of charge respectively calculated by the first calculating section and the second calculating section, an amount of ions to be generated by the ion generating section.

16. The image forming apparatus as set forth in claim 15, further comprising an opening switching section for switching a proportion of (i) an area of a first opening through which the ion generating section is communicated with the first duct to (ii) an area of a second opening through which the ion generating section is communicated with the second duct, wherein the control section includes a flow control section for, by controlling movement of the opening switching section in accordance with calculation results respectively yielded by the first calculating section and the second calculating section, switching a proportion of (a) an amount of ions to be supplied from the ion generating section to the first duct to (b) an amount of ions to be supplied from the ion generating section to the second duct.

* * * * *